United States Patent [19]

Olsson

[11] 4,205,618

[45] Jun. 3, 1980

[54] TRIMMING AND STABILIZING SYSTEMS

[76] Inventor: Gerhard G. R. Olsson, Via S:Ambrigo 30, 160 35 Rapallo, Italy

[21] Appl. No.: 870,588

[22] Filed: Jan. 18, 1978

[30] Foreign Application Priority Data

Jan. 18, 1977 [SE] Sweden ..... 7700478

[51] Int. Cl.[2] ..... B63H 5/13; B63H 21/26

[52] U.S. Cl. ..... 114/281; 115/17; 115/42

[58] Field of Search ..... 115/34 R, 35, 17, 18 R, 115/42; 114/126, 281, 285, 280

[56] References Cited

U.S. PATENT DOCUMENTS

| | | | |
|---|---|---|---|
| 904,313 | 11/1908 | Davis | 115/42 |
| 1,226,400 | 4/1917 | Smith | 115/17 |
| 2,791,196 | 5/1957 | Strang | 115/17 |
| 2,963,000 | 12/1960 | Fester | 115/17 |
| 3,768,432 | 10/1973 | Spaulding | 115/42 |

FOREIGN PATENT DOCUMENTS 2276216 1/1976 France .

*Primary Examiner*—Stephen G. Kunin

*Assistant Examiner*—D. W. Keen

*Attorney, Agent, or Firm*—Burns, Doane, Swecker & Mathis

[57] ABSTRACT

Provided is a trimming and stabilizing arrangement for motor-driven vessels of the type in which the engine of the vessel is placed in the stern thereof and comprises either an outboard engine or an inboard engine with an outboard drive, wherein the propeller driven by the engine is located beneath a holding device in the form of a fin, serving as a stabilizer, and wherein the steering of the vessel is effected by pivoting the propeller about a vertical axis. A plate is arranged to coact with the fin and extends over the propeller and beyond the propeller sternwardly of the vessel. The plate has a downwardly facing planar surface, the edges of which in the direction of movement of the vessel are curved downwardly. The holding device and plate comprise at least two parts, one of which co-acts with and embraces the motor leg of the engine immediately above the propeller, and the other part comprises a planar plate co-acting with the holding device via attachment apparatus.

21 Claims, 2 Drawing Figures

Figure 2:
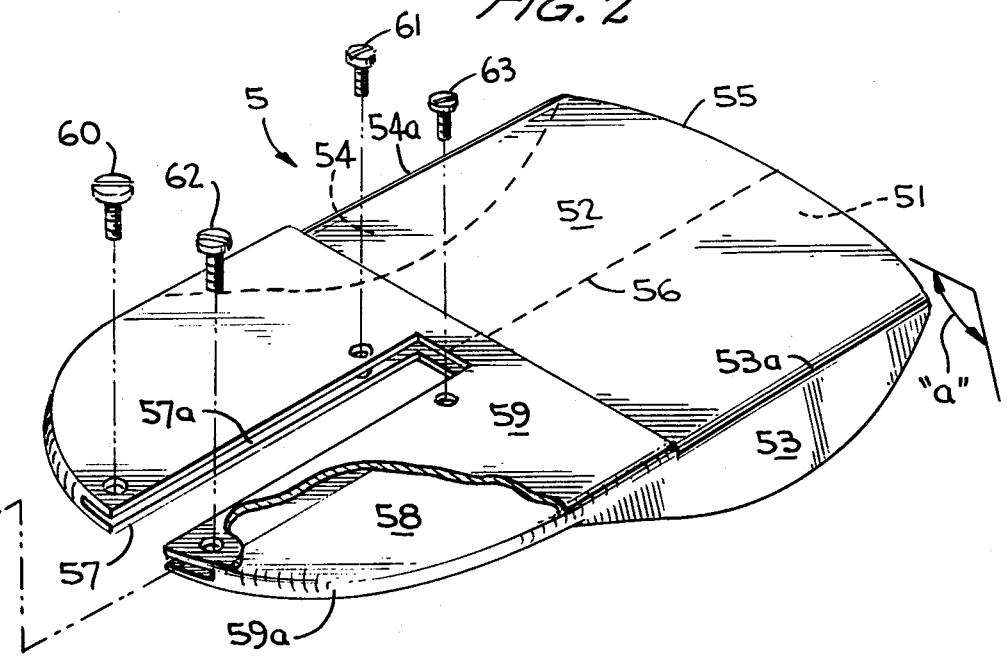

"a"
51
55
53a
53
56
52
59
63
61
54a
54
5
58
59a
62
57a
60
57

2a
45
2
1
4
48
3
46
47
41
46a
42
41a
41b

TRIMMING AND STABILIZING SYSTEMS

FIELD OF THE PRESENT INVENTION

The present invention relates to a boat-trimming and stabilizing system for use with water-going vessels and in particularly for use with such vessels which are powered by an engine placed in the stern thereof. In the case of motor-powered vessels in which the engine is mounted in the stern of the vessel, the engine has either the form of an outboard engine or of an inboard engine with an outboard drive. These engines are adapted to drive a propeller, which is normally placed beneath two stabilizing fins arranged on the motor leg.

DESCRIPTION OF THE PRIOR ART

It is a known fact that with every vessel driven by an outboard engine or an inboard engine with outboard drive, the weight of the engine causes the load on the stern to be excessive. This causes the stern of the vessel to "bury itself" in the water, giving rise to a significant water-wake. This is true both with respect to vessels which displace water and those which do not.

It is known to arrange adjacent to the lower part of the stern on the starboard and port sides of a vessel fixed or regulateable support surfaces or trimming surfaces. The regulateable trim surfaces are pivotally arranged at the lower portion of the stern, the most sternward end of said trim devices being raisable and lowerable by means, for example, of hydraulicaly actuable piston-cylinder arrangements. By urging the free end of the trimming device downwardly, by means of the piston-cylinder arrangement it is possible to generate on the stern of the vessel an upwardly directed force, thereby to impart to the vessel a substantially horizontal attitude in the water. It will be understood that an arrangement which uses two trimming devices mounted on respective sides of the vessel is relatively expensive to provide. In addition, such an arrangement requires a multiplicity of auxiliary devices for adjusting the trimming devices to the desired trim position. These auxiliary devices include hydraulic pumps, electrical operating devices and valves.

Consequently, it is normally only very expensive vessels on which such a complicated arrangement is mounted.

OBJECTS OF THE PRESENT INVENTION

It is desirable, however, to mount trimming devices also to smaller motor-driven vessels, and an object of the present invention is to provide an inexpensive system which will serve as a trimming device. In addition to trimming a vessel to which it is fitted the system will also be effective to conduct exhaust gases, which normally tend to rise up immediately sternward of the transom, to a place more remote therefrom.

Practical tests, carried out under strict secrecy conditions on a proto-type system, have shown that the system according to the present invention not only provides the desired technical effect when functioning as a trimming device but, when the vessel yaws, also serves to stabilise said vessel, and serves as a rudder. An additional feature of said system is that it serves to protect the propeller against floating objects in the water.

BRIEF DESCRIPTION OF THE ACCOMPANYING DRAWING

Figure 1:
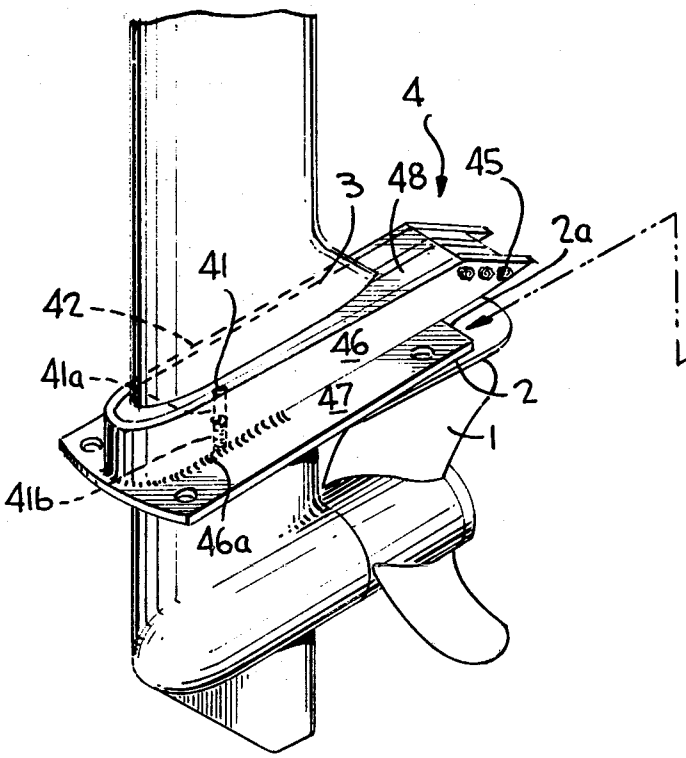

A preferred embodiment of the invention will now be described in more detail by way of example only with reference to the accompanying schematic drawing; in which FIG. 1 is a perspective view of the lower portion of an outboard drive completed with one part, the holding part, of the trimming and stabilizing system constructed according to the invention and FIG. 2 is a perspective view of a second part of the system.

DESCRIPTION OVER A PREFERRED EMBODIMENT

Since the present invention does not incorporate the vessel to which the engine is coupled or generally to the engine by which the vessel is powered, no reference to the vessel will be made and reference to the engine will only be made with respect to those parts of the outboard engine or outboard drive directly associated with the present invention. In FIG. 1 there is shown a motor-driven propeller 1 located beneath a fin 2. The position of said fin is immediately above the propeller. The outboard engine or outboard drive by which the vessel is powered is provided with a further fin 3 arranged at a distance above the fin 2. The fins are arranged on the motor leg.

Arranged to co-act with the surface arranged between the fin 2 and the fin 3 is a holding means for an elongate trimming member 5. In order to trim the vessel the elongated trimming member 5 extends over the propeller 1 and terminates at a considerable distance beyond the propeller in the stern direction of the vessel. The member 4 comprises three, mutually connected parts, namely 46, 47 and 48. The part 47 is a plate having an U-formed recess in oder to surround the motor leg. To this plate 47 a strip 46 is welded at 46*a*. Between the strip 46 and the motor leg is a rubber device 48. The strip 46 is secrewed together at its free ends by three screws 45.

As previously mentioned, the member 5 is of elongate configuration and extends, when cooperating with the member 4, beyound the transom of the vessel. Preferably the trimming member 5 will extend from about 0.5 to 0.7 meters sternwards from the propeller 1 or from the sternward end 2*a* of the fin 2. The breath of the member 5 has been given the distance corresponding to twice the diameter of the propeller.

The edges 53 and 54 form an angle with the planar downwardly facing surface 51, said angle being referenced "a". This angle will lie within the range 90° to slightly less than 180°. Practical tests have shown that the angular range should be within 90°–120°, preferably approximately 135°.

The fins 2 and 3 are parallel with the planar downwardly facing surface 51 in the horizontal attitude of said surface, which may incline downwardly as will be seen from FIG. 1.

The member 4 is arranged to co-act with the surface between the fins 2 and 3 via adjustable setting devices 41 and 42, device 42 being arranged on the starboard side of the vessel and the device 41 being arranged on the portside thereof. The adjustable setting devices 41 and 42 are also arranged to co-act with the fin 2. The arrangement of the setting devices 41 and 42 is such that said devices 4 and 5 are able to move the downwardly extending planar surfaces 51 to an angle of between 0° and 5° inclusive relative to the horizontal plane or to the fin 2. Practical tests have shown that the planar surface should be regulatable at least within an angle of 1°-5°, preferably within the range of 1.5°-3°. It will be obvious that the planar surfaces 51 and 52 taper in a direction away from the propeller 1 sterwardly.

Each of the setting devices, such as setting device 41, comprises a thread hole 41*a* provided with an internal screw 41*b* thread and securely mounted to the trimming member 4. The screw may be conveniently provided with a non-threaded portion which may have a square or hexagonal configuration and which is intended to abut the fin 2. The important feature is that the free end of the screw can be adjusted up and down so as to move the members 4 and 5 to a desired angle relative to the horizontal plane or the fin 2.

The most sternward end 2*a* of the fin 2 co-operates with the member 4 and the part 47 through two screw joints 61 and 63 over which the member 4 is pivotable within the range described by means of the setting means 41 and 42.

One advantage afforded by the arrangement according to the invention, is that when moving astern, a vessel provided with said arrangement can be steered much better than a vessel not provided with the arrangement. Further, it has been found tht when moving astern in banks of reed, the reeds are caused to bend and are then cut by the propeller blade. Finally, the arrangement according to the invention protects the propeller against objects floating in the water.

It should be observed that in the case of heavier vessels, the aformentioned angular value should approach 5°. In this case it is possible to permit the part 47 and the setting devices 41 and 42 to form an angle of approximately 3° to the plane and to adapt the setting devices to vary the setting between 5° and 1°.

Owing to the position of the fin in the wake behind the propeller, the wake will be divided centrally (when the vessel is moving forward) thereby preventing water from being whipped up in a cascade sternwards of the vessel.

The member 5 has a planar surface 52 onto which a further planar surface 59 is welded at 59*a*. A recess 57*a* is formed to co-act with the plane member 47. By screws 60, 61, 62 and 63 the member 5 is secured to the member 4.

It is intended that the rubber part 48 shall have a shape on its inner surface corresponding to or essentially corresponding to the motor leg and an outer shape corresponding to the shape of the members 47 and 48. The rubber part 48 may be adjustable to a specific motor leg.

The welding 59*a*is rounded in order to reduce the water resistance.

The invention is naturally not restricted to the exemplary embodiment thereof, but can be modified within the scope of the following claims.

What is claimed is:

1. A stabilizing and trimming arrangement intended for motor-driven vessels of the type in which the engine of the vessel is placed in the stern thereof and has a propeller driven by said engine located beneath a motor leg, said motor leg having a substantially horizontal fin mounted thereto above said propeller, and in which steering of the vessel is effected by pivoting said motor leg about a vertical axis, comprising:

a. a holding means mounted to the substantially horizontal fin of said motor leg with an adjustable angle of inclination with respect to said fin;

b. an elongate plate member removably mounted to said holding means and extending over and beyond said propeller sternwardly of the vessel, said plate having a downwardly facing planar surface and edges curved downwardly in the direction of movement of the vessel; and c. means mounted on said holding means which engage the substantially horizontal fin of said motor leg for adjusting the inclination of said holding means and plate member with respect to the substantially horizontal fin of said motor leg.

2. An arrangement according to claim 1, characterised in that said plate has a length of from 0.5-0.7 m.

3. An arrangement according to claim 1, characterised in that said edges form an angle with the downwardly facing surface within the range of 90° to slightly less than 180°.

4. An arrangement according to claim 3, characterised in that said range is from 120°-150°, preferably approximately 135°.

5. An arrangement according to claim 4, characterised in that the holder means and the plate are held together by screw joints.

6. An arrangement according to claim 5, characterised by a space between said holder means and a part of the engine located immediately above the propeller, said space being filled with rubber elements or the like.

7. An arrangement according to claim 1, characterised in that said plate co-acts with a fin arranged above the propeller.

8. An arrangement according to claim 7, characterised in that the length of the plate corresponds substantially to the total width of the planar surface.

9. An arrangement according to claim 7, characterised in that the length of the plate is shorter than the length of said edges.

10. An arrangement according to claim 7, characterised in that said fin is arranged beneath said plate.

11. An arrangement according to claim 1, characterised in that said plate co-acts with the fin via adjustable setting devices.

12. An arrangement according to claim 11, characterised in that said setting devices are so arranged as to be able to move said downwardly facing surface through an angle of between 0°-5° relative to a horizontal plane, alternativley relative to said fin.

13. An arrangement according to claim 12, characterised in that the planar surface tapers in a direction away from the propeller.

14. An arrangement according to claim 11, characterised in that said setting devices comprise a sleeve having an internal screw thread firmly mounted to a respective part with which sleeve a screw having a corresponding screw thread co-acts said screw preferably having a non-threaded portion of square or hexagonal configuration which is arranged to abut said fin or a further arranged parallel to said fin.

15. An arrangement according to claim 14, characterised in that said planar surface is regulatable within an angular range of 1°-4°, preferably within an angular range of 1.5°-3°.

16. An arrangement according to claim 1, characterised in that the most downward end of the fin co-acts with said plate over which co-action point said plate is tiltable.

17. An arrangement according to claim 1, characterised in that said edges commence immediately adjacent the propeller or slightly sternwardly thereof.

18. An arrangement according to claim 1, characterised in that said planar surface on one side of said fin and the planar surface on the other side thereof form an angle of less than 180° with each other, preferably less than 150°.

19. A stabilizing and trimming arrangement intended for motor-driven vessels of the type in which the engine of the vessel is placed in the stern thereof and has a propeller driven by said engine located beneath a motor leg, said motor leg having a substantially horizontal fin mounted thereto above said propeller, and in which steering of the vessel is effected by pivoting said motor leg about a vertical axis, comprising:

a. a holding means mounted to the substantially horizontal fin of said motor leg with an adjustable angle of inclination with respect to said fin;

b. an elongate plate member removably mounted to said holding means and extending over and beyond said propeller sternwardly of the vessel, said plate having a downwardly facing planar surface and edges curved downwardly in the direction of movement of the vessel; and c. means mounted on said holding means which engage the substantially horizontal fin of said motor leg for adjusting the inclination of said holding means and plate member with respect to the substantially horizontal fin of said motor leg, said means comprising an internal screw thread disposed in said holding means, and a screw which rides in said internal screw thread and is engageable with said substantially horizontal fin.

20. The arrangement according to claim 19, characterised in that said plate member is regulatable within an angular range of 1°–4°.

21. The arrangement according to claim 19, characterised by a space between said holder means and a part of the motor leg located immediately above the propeller, said space being filled with rubber elements or the like.

* * * * *